US010399748B2

(12) United States Patent
Reinhart

(10) Patent No.: US 10,399,748 B2
(45) Date of Patent: Sep. 3, 2019

(54) CONTAINER LID WITH STACKING SUPPORTS

(71) Applicant: Creative Plastic Concepts, LLC, Sycamore, OH (US)

(72) Inventor: Nickolas Reinhart, Findlay, OH (US)

(73) Assignee: Creative Plastic Concepts, LLC, Sycamore, OH (US)

( * ) Notice: Subject to any disclaimer, the term of this patent is extended or adjusted under 35 U.S.C. 154(b) by 272 days.

(21) Appl. No.: 15/298,317

(22) Filed: Oct. 20, 2016

(65) Prior Publication Data

US 2017/0107015 A1 Apr. 20, 2017

Related U.S. Application Data

(60) Provisional application No. 62/243,708, filed on Oct. 20, 2015.

(51) Int. Cl.
*B65D 43/03* (2006.01)
*B65D 43/02* (2006.01)

(52) U.S. Cl.
CPC ..... *B65D 43/0214* (2013.01); *B65D 2543/00027* (2013.01); *B65D 2543/00194* (2013.01); *B65D 2543/00296* (2013.01); *B65D 2543/00398* (2013.01)

(58) Field of Classification Search
CPC ..... B65D 2543/00027; B65D 21/0217; B65D 2519/00427
USPC ..... 220/781, 380
See application file for complete search history.

(56) References Cited

U.S. PATENT DOCUMENTS 5,881,880 A * 3/1999 Jacques ..... B65D 11/1833 206/504
2012/0304898 A1* 12/2012 Dubois ..... B65D 19/0063 108/57.25

FOREIGN PATENT DOCUMENTS

CA 160480 8/2015
CA 160481 8/2015
DE 29506402 U1 * 6/1995 ..... B65D 43/0218

OTHER PUBLICATIONS

DE_29506402_translation.pdf.*

* cited by examiner

*Primary Examiner* — Allan D Stevens
(74) *Attorney, Agent, or Firm* — Jacob M. Ward; Ward Law Office LLC

(57) ABSTRACT

A stackable lid for a container includes a main body having an interior portion circumscribed by a lip. The interior portion has a plurality of raised surface features, a plurality of channels, and a plurality of connecting bridges formed therein. A plurality of bosses extend from the interior portion of the main body. Each of the bosses includes a plurality of sidewalls. At least one support feature depends from an interior surface of at least one of the bosses.

12 Claims, 7 Drawing Sheets

CONTAINER LID WITH STACKING SUPPORTS

CROSS-REFERENCE TO RELATED APPLICATIONS

This application claims the benefit of U.S. Provisional Application No. 62/243,708, filed on Oct. 20, 2015. The entire disclosure of the above application is hereby incorporated herein by reference.

FIELD

The disclosure generally relates to container lids and, in particular, a lid with stacking supports to facilitate stacking of multiple lids.

BACKGROUND

Containers with lids are commonly used for commercial or residential applications. It is typical to store articles such as tools, recreational equipment, supplies, materials, and the like in the containers. The lids cover an open end of the container to secure and protect the articles contained within the container.

Lids may be transported and stored in various arrangements, such as by stacking the lids. To facilitate stacking, lids are often designed to be partially received within one another, wherein an upper exterior portion of a first lid is received within a lower interior portion of a second lid. This may include tapering various features of the lid, wherein an exterior cross section of an upper portion of the feature is smaller than an interior cross section of a lower portion of the feature.

However, conventional container lids may not contain sufficient strength or stability to support a substantial number of lids that may stacked together. For example, as the number of lids in a stack increases, the weight of the lids forces the lids together, thereby causing the tapered portions of the lid to be splayed outwards as the depth the first lid within the second lid increases. After a period of time, lids stored in this manner may become permanently deformed. Such deformation can result in the lids not fitting or mating correctly with their respective containers in end use.

Accordingly, there is a continuing need for a container lid that is configured for stacking and has sufficient strength and stability to militate against warping or damage during transportation and storage.

SUMMARY

In concordance with the instant disclosure, a lid for a container lid that is configured for stacking and has sufficient strength and stability to militate against warping or damage during transportation and storage, has surprisingly been discovered.

In one embodiment, a stackable lid includes a main body having an interior portion circumscribed by a lip. The interior portion has a plurality of raised surface features, a plurality of channels, and a plurality of connecting bridges formed therein. A plurality of bosses extend outwardly from the interior portion of the main body. Each of the bosses includes a plurality of sidewalls. At least one support feature depends from an upper-interior surface of at least one of the bosses.

The support feature may include a planar contact surface, configured to abut an upper-exterior surface of a corresponding boss when a second one of the lids is stacked upon a first one of the lids. The lid may include a plurality of the support features, wherein a plurality of the bosses includes at least one of the support features.

The support feature may be at least one of a tubular shape and cross shape, as non-limiting examples. A reinforcing rib may be formed on an exterior of the support feature, and may connect to one of the sidewalls of the boss. An entirety of each support feature may be contained within a perimeter formed by the sidewalls of the boss from which the support feature depends.

In another embodiment, a stackable lid for a container includes a main body, a plurality of bosses, a first support feature, and a second support feature. The main body has an interior portion circumscribed by a lip. Each of the plurality of bosses extend from the interior portion of the main body, and includes a plurality of sidewalls. The first support feature depends from an interior surface one of the bosses, and is tubular in shape. The second support feature depends from an interior surface of another of the bosses, and is cross shaped. In particular, the first support features is disposed at a corner of the main body, and the second support feature is disposed adjacent a handle area of the main body.

In a further embodiment, an assembly of stackable lids includes a first stackable lid and a second stackable lid. Each of the first stackable lid and the second stackable lid has a main body with an interior portion circumscribed by a lip. A plurality of hollow bosses extend from the interior portion of the main body. Each of the bosses includes a plurality of sidewalls. At least one first support feature depends from an interior surface of at least one of the bosses of the first stackable lid. At least one second support feature depends from an interior surface of at least one of the bosses of the second stackable lid.

The second stackable lid is nested with and abut the first stackable lid. The at least one first support feature of the second stackable lid abuts an exterior surface of one of the bosses of the first stackable lid. Furthermore, the at least one first support feature and the at least one second support feature are aligned on a same axis oriented substantially orthogonal to the interior portions of each of the first stackable lid and the second stackable lid. Advantageously, this alignment and abutting of first support feature and the second support feature effectively forms a beam or rod across a thicknesses of the assembly of the stackable lids, which militates against a deformation of the stackable lids over time while stacked for transport or storage.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
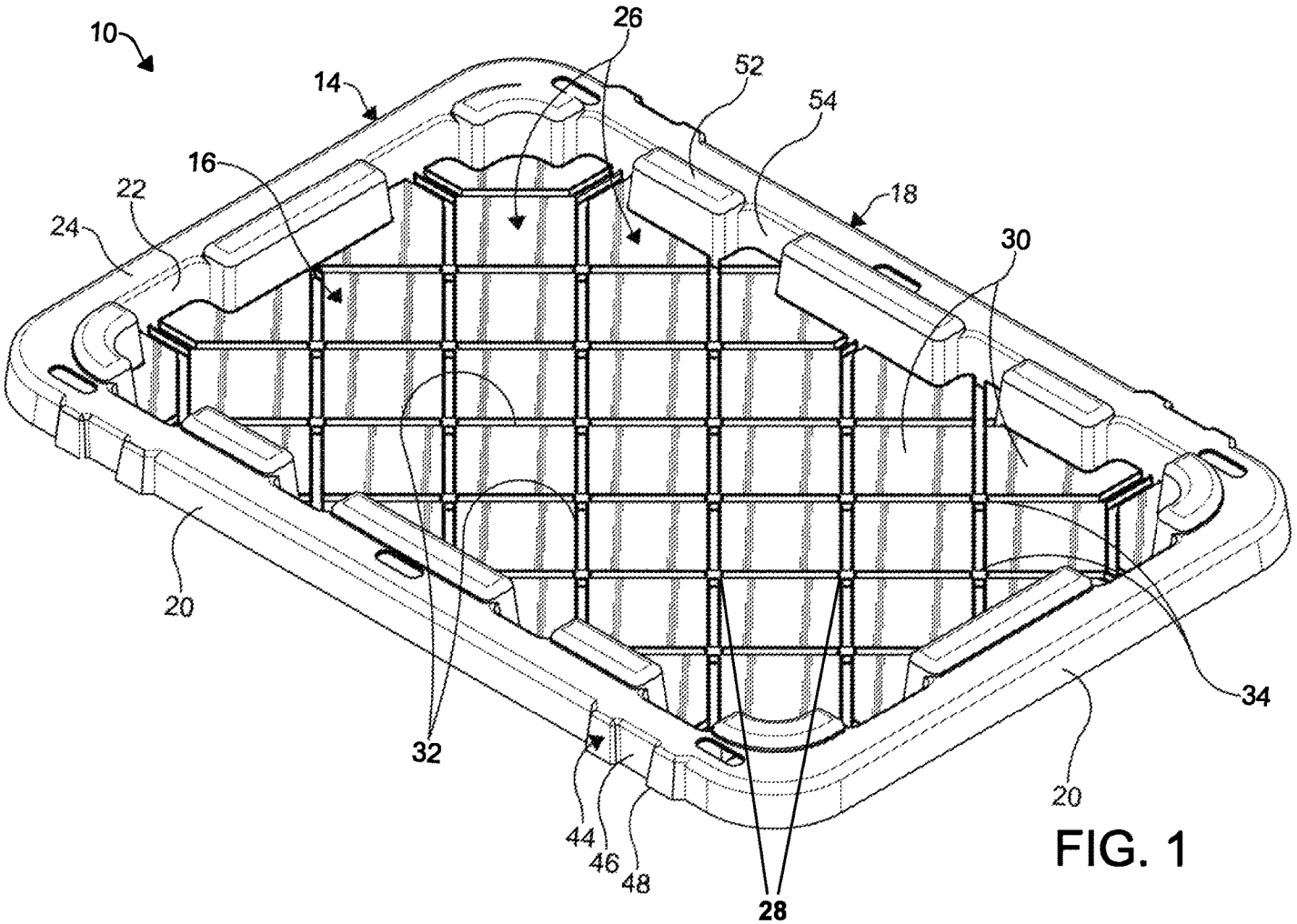
FIG. 1 is a top perspective view of a lid according to an embodiment of the disclosure.
Figure 2:
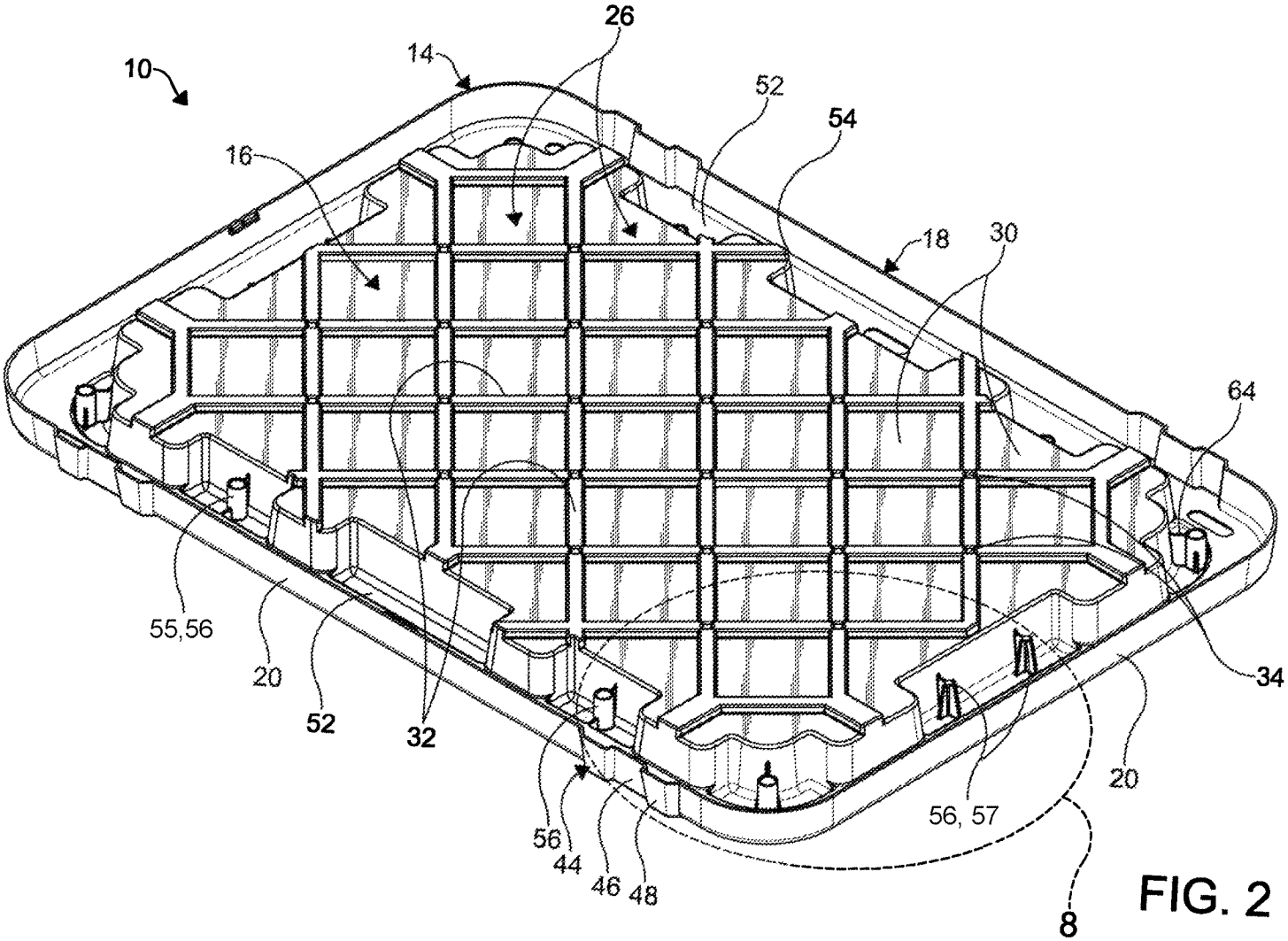
FIG. 2 is a bottom perspective view of a lid according to an embodiment of the disclosure.
Figure 3:
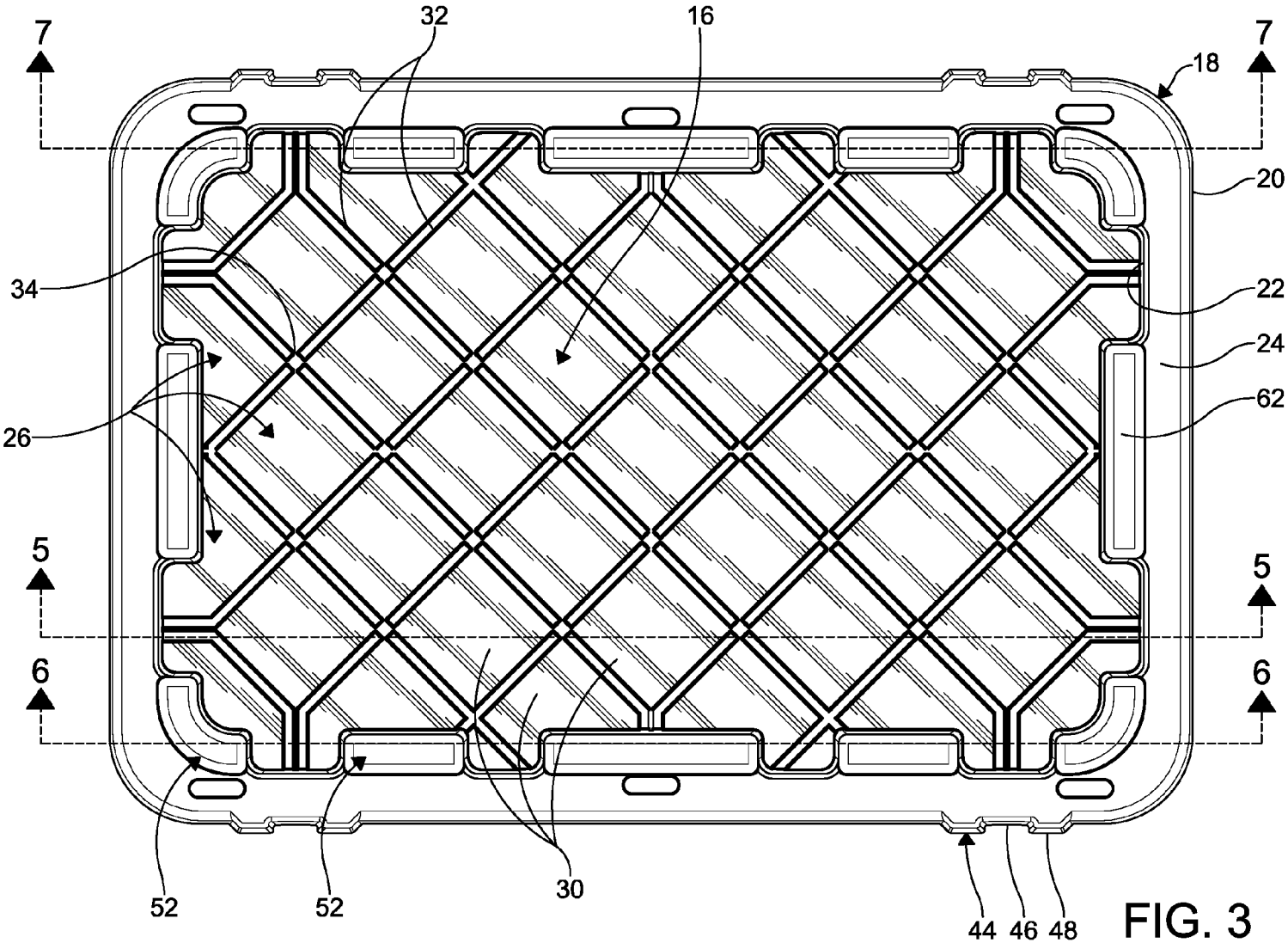
FIG. 3 is a top plan view of the lid shown in FIG. 1.
Figure 4:
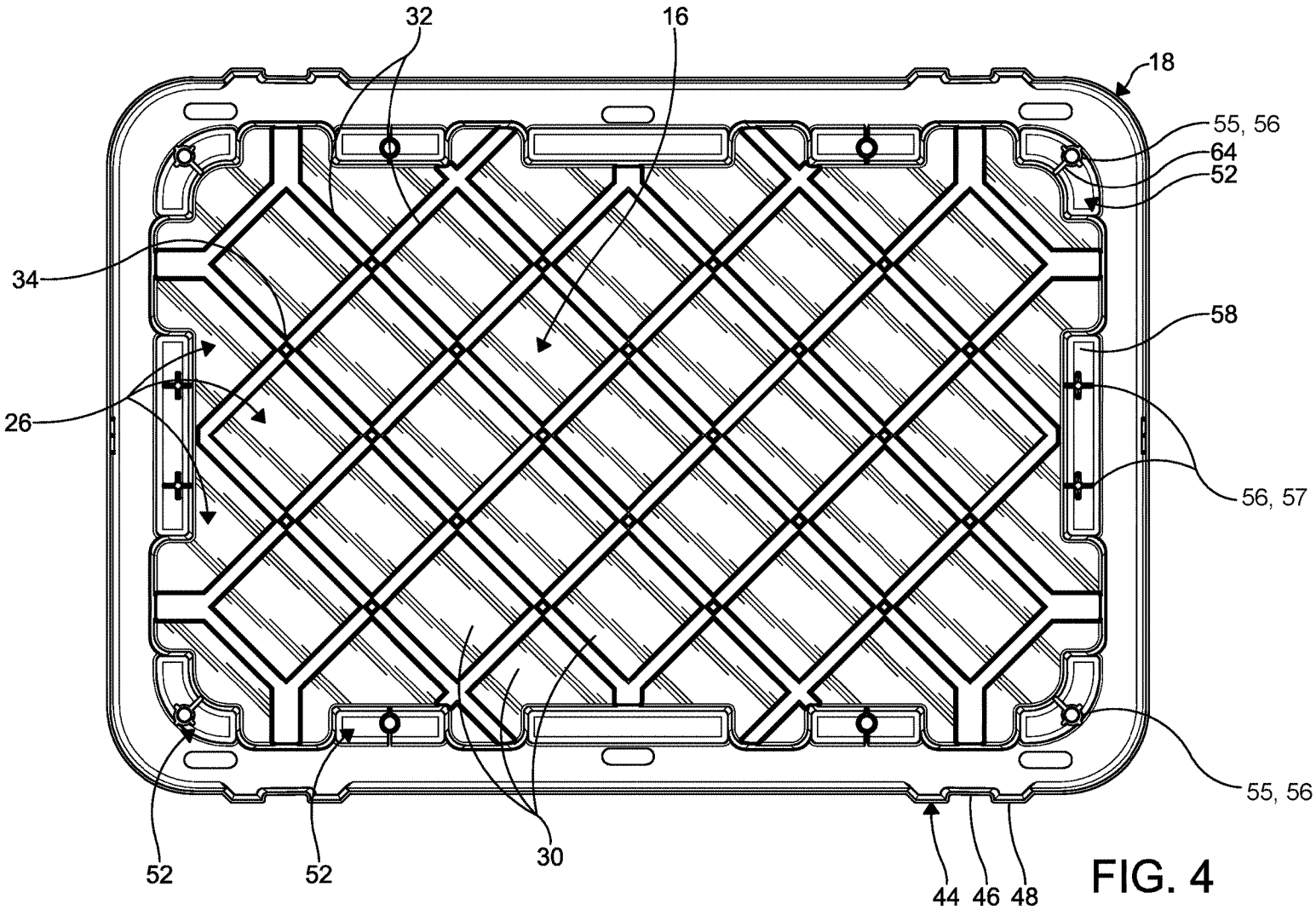
FIG. 4 is a bottom plan view of the lid shown in FIG. 1.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical unless otherwise disclosed.

Referring to FIGS. 1-8 there is illustrated a lid 10 for use with a container (not shown) for storing articles such as tools, recreational equipment, supplies, materials, and the like. The lid 10 may be formed from a polymeric material, such as plastic, by an injection molding process. In alternate embodiments, the lid 10 may be formed using other materials, such as a metal or a composite, and processes, such as blow molding, as non-limiting examples.

The lid 10 includes a main body 14 having an interior portion 16 circumscribed by a lip 18. In the illustrated embodiment, an outer edge 20, an inner edge 22, and an upper edge 24 of the lip 18 are configured to engage of an open end of the container by receiving a sidewall of the container therein. However, in alternate embodiments, the lip 18 of the lid 10 may receive another portion of the container.

In certain embodiments, the lid 10 has a substantially rectangular shape. However, other shapes are contemplated to accommodate a respective container shape, such as a square shape, a circular shape, or any polygonal shape, as non-limiting examples.

Figure 5:
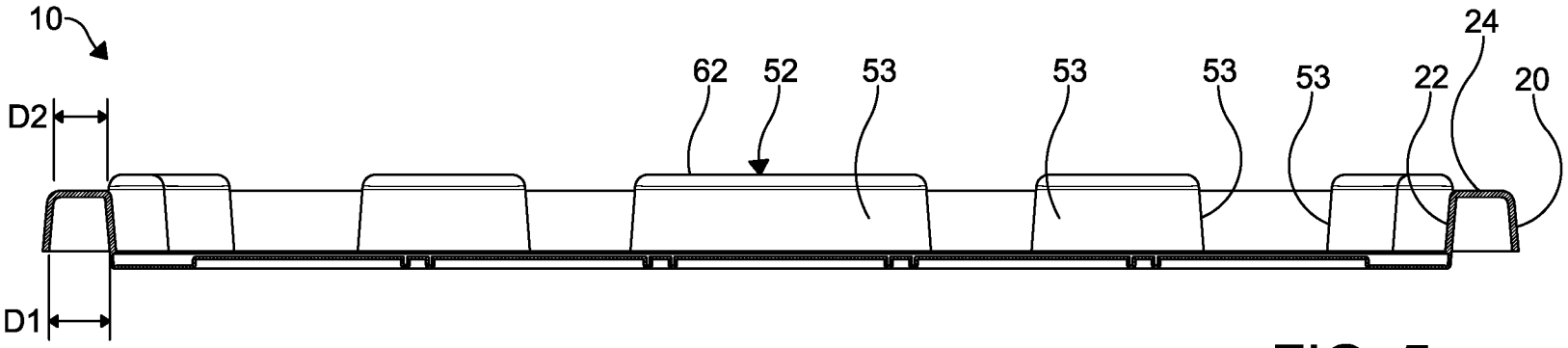
FIG. 5 is a cross-sectional view of the lid shown in FIG. 1, taken through section line 5-5 on FIG. 3.
Figure 7:
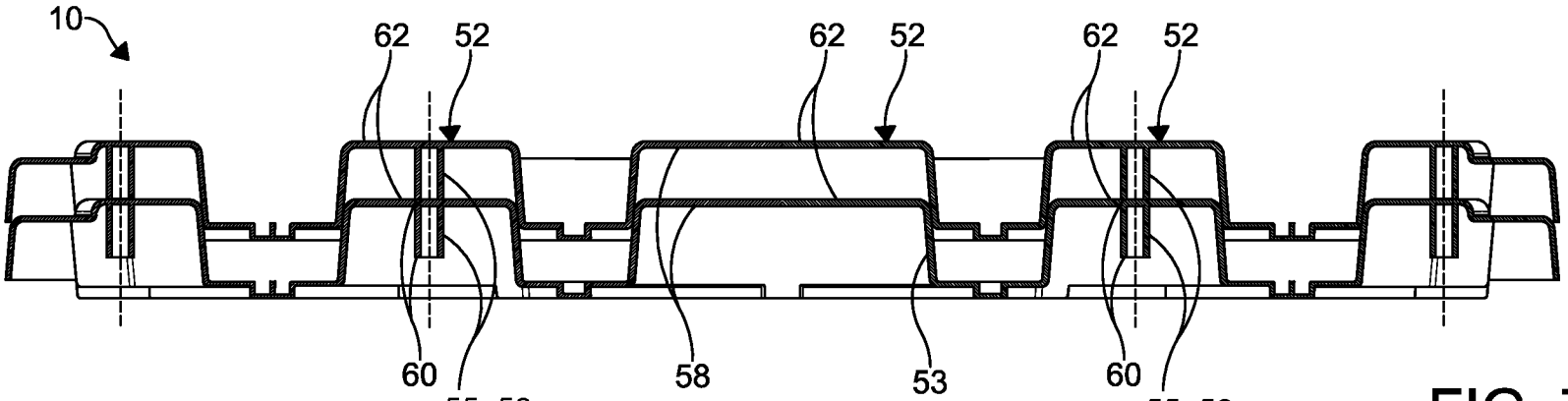
FIG. 7 is a cross-section view of the lid shown in FIG. 1, taken through section line 7-7 on FIG. 3, wherein a second one of the lids is stacked upon a first one of the lids.

As shown in FIG. 5, the outer edge 20 and the inner edge 22 of the lip taper outwardly toward, wherein a distance (D1) between an interior surface of the inner edge and an interior surface of the outer edge at a first height is greater than a distance (D2) between an outer surface of the inner edge and an outer surface of the outer edge at a second height. The tapered configuration facilitates reception of a portion of the lip 18 of a first lid 10 within a portion of the lip 18 of a second lid 10 when the lids are stacked upon each other, as shown in FIG. 7.

Referring again to FIGS. 1-7, a plurality of surface features 26 are formed on at least a portion of the interior portion 16 of the lid 10. As illustrated, the plurality of surface features 26 envelop an entirety of the interior portion 16 of the lid 10, wherein the plurality of surface features 26 terminates at the lip 18 of the lid 10.

In the illustrated embodiments, each of the surface features 26 is a square-shaped boss. However, the surface features 26 can be any shape as desired, such as polygonal, circular, irregular, or a combination thereof, for example. Each of the surface features 26 includes a plurality of corners 28 and a substantially planar upper surface 30. The upper surfaces 30 of the surface features 26 are aligned along a common plane with each other, forming a substantially planar upper surface of the interior portion 16.

The surface features 26 are arranged in a grid, wherein the surface features 26 are aligned in a series of adjacent rows and columns. A lattice of channels 32 is formed intermediate the surface features 26, wherein a first plurality of the channels 32 is arranged perpendicular to a second plurality of the channels 32. In the illustrated embodiment, the grid of the surface features 26 is diagonally oriented with respect to the inner edge 22 of the lip 18 of the lid 10. More particularly, the surface features 26 and channels 32 are oriented at a 45 degree angle to the inner edge 22 of the lip 18. In alternate embodiments, other arrangements and orientations are contemplated, such as a perpendicular oriented grid, a radial array, or an irregular arrangement.

The lid 10 includes a plurality of connecting bridges 34 interposed between the surface features 26 and within the channels 32. The connecting bridges 34 join adjacent surface features 26, providing continuity between the upper surfaces 30 of adjacent surface features 26. As illustrated in the embodiments disclosed in FIGS. 1-4, the connecting bridges 34 are formed at intersections of the first plurality of the channels 32 and the second plurality of the channels 32. Alternatively, the connecting bridges 34 may be disposed within the channels 32 at any location suitable to connect at least two of the surface features 26 to each other, such as along sides of the surface features 26, for example.

As illustrated in FIGS. 1-4, the lid 10 also includes at least one guide 44 formed on the lip 18 of the lid 10. The guide 44 includes a recess 46 formed intermediate a pair of protuberances 48 extending from the outer edge 20 of the lip 18. The recess 46 of the guide 44 is configured to receive and retain a portion of a securement device (not shown), such as a bungee cord, rope, strap, or other fastening device to facilitate securement of the lid 10 to the container.

The lid 10 may include any number of guides 44 formed thereon, as desired, for optimal securement. In a non-limiting example, as illustrated in FIGS. 1-4, the lid 10 includes eight guides 44 formed on the outer edges 20 of the lip 18, wherein each of the outer edges 20 includes a pair of guides 44 disposed at opposing ends thereof. Each of the guides 44 on a first one of the outer edges 20 is aligned with one of the guides on an opposing one of the outer edges 44.

Figure 6:
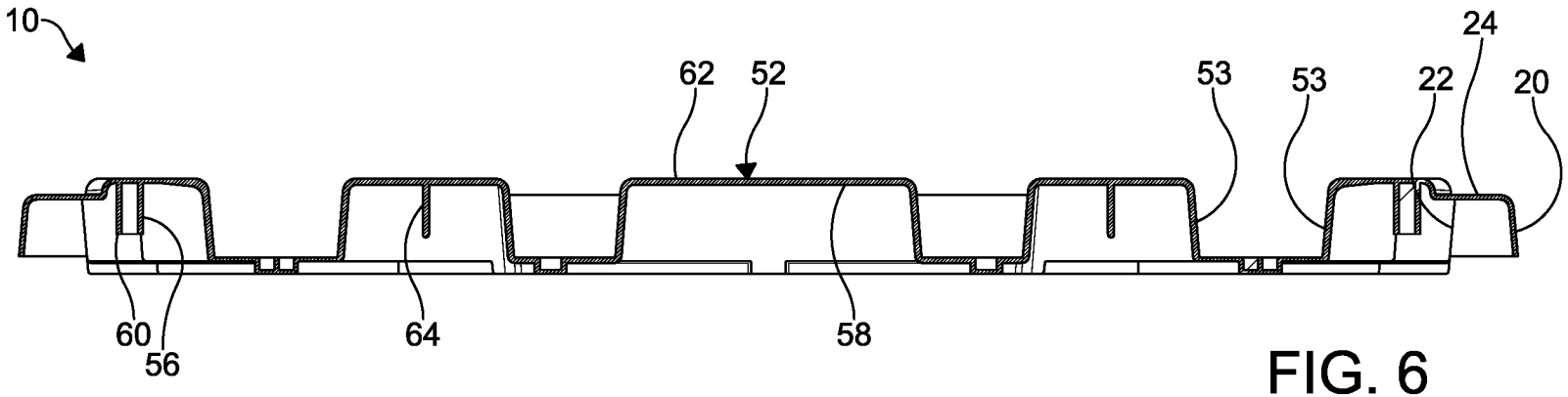
FIG. 6 is a cross-sectional view of the lid shown in FIG. 1, taken through section line 6-6 on FIG. 3.

With continuing reference to FIGS. 1-7, a plurality of bosses 52 may be formed on the inner edges 20 of the lip 18 of the lid 10. The bosses include a plurality of sidewalls 53. Similar to the outer edge 20 and the inner edge 22 of the lip 18, the sidewalls 53 of the bosses 52 may be tapered outward to facilitate stacking of the lids 10, as shown in FIGS. 5-7.

In the illustrated embodiment, at least one boss 52 is formed along each of the inner edges 20 of the lip 18. The bosses 52 extend from the upper surfaces 30 of the surface features 26 of the lid 10 and protrude beyond the upper edge 24 of the lip 18 of the lid 10. The bosses 52 are configured to cooperate with the guides 44 to maintain an alignment of the securement device across the lid 10 for fastening the lid 10 to the container. Also in the illustrated embodiment, spaces 54 formed intermediate each of the bosses 52 may be substantially aligned across the upper edge 24 with corresponding ones of the recesses 46 of the guides 44.

As shown in FIGS. 2, 4, and 6-8, the lid 10 includes a plurality of support features 56 formed thereon. In the illustrated embodiment, the support features 56 depend from an upper-interior surface 58 of at least one of the bosses 52. An entirety of each of the support features 56 is contained within a perimeter formed by the sidewalls 53 of the respective boss 52. In the illustrated embodiment, less than all of the bosses 52 include at least one support feature 56 formed therein. In alternate embodiments, all of the bosses 52 may include at least one of the support features 56 formed therein.

Figure 8:
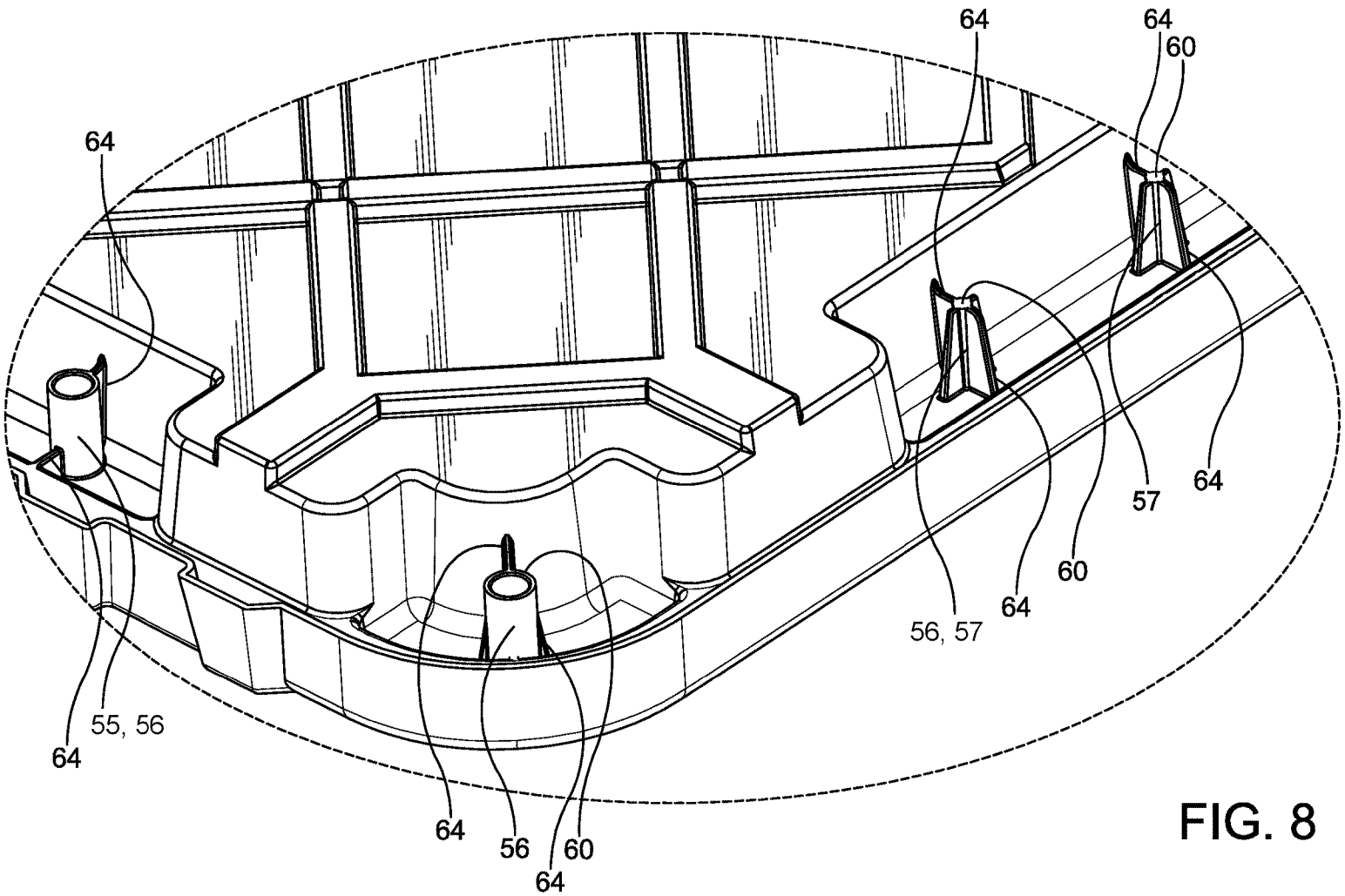
FIG. 8 is an enlarged, fragmentary bottom perspective view of the lid of FIG. 1, taken at area 8 in FIG. 3.

As detailed in FIG. 8, the support features 56 are protrusions having a planar contact surface 60 at a distal end thereof. The planar contact surface 60 is substantially parallel to an upper-exterior surface 62 of the boss 52. In the illustrated embodiment, the each of the support features 56 is one of a tubular support feature 55 and a cross-shaped support feature 57. The support feature 56 may be include at least one reinforcing rib 64 formed on an exterior thereof. At least one of the reinforcing ribs 64 may connect to a sidewall 53 of the boss 52, thereby militating against deflection between the support feature 56 and the boss 52, and of the lid 10 as a whole.

The tubular support feature 55 according to the present disclosure may include a hollow cylinder that extends outwardly from the interior surface of the boss 52 within which it is disposed. The tubular support feature 55 may also include one or more support fins or ribs attached to an outer surface of the hollow cylinder at a base of the hollow cylinder. The support fins or ribs may be attached to the same interior surface from which the hollow cylinder extends, and may also be angled so as to only extend partly along a length of the hollow cylinder. As such, it should be appreciated that the support fins or ribs may have a height less than a height of the hollow cylinder to which they are attached, and facilitate an orientation of the hollow cylinder in an upright and stable position even when supporting the weight of many additional lids 10 in a stacked configuration.

The cross shaped support feature 57 according to the present disclosure may include a solid beam or cylinder that extends outwardly from the interior surface of the boss 52 within which it is disposed. The cross shaped support feature 57 has a plurality of the support fins or ribs, and in a most particular embodiment four support fins or ribs, attached to an outer surface of the solid beam at a base of the solid beam. The support fins or ribs may be attached to the same interior surface from which the solid beam extends, and may also be angled to as to only extend partly along a length of the solid beam. As such, it should be appreciated that the support fins or ribs may have a height less than a height of the solid beam to which they are attached, and facilitate an orientation of the solid beam in an upright and stable position even when supporting the weight of many additional lids 10 in a stacked configuration.

In a most particular embodiment, as shown in FIGS. 7-8, the stackable lid 10 for the container has both the first support feature 55 and the second support feature 57. The first support feature 55 is tubular in shape, and depends from the interior surface of one of the bosses 52, for example, at a corner and at an elongate side of the lid 10. The second support feature 57 is cross shaped, and depends from the interior surface of one of the bosses 52, for example, at a handle area at an end of the lid 10.

The lid 10 can cooperate with any container as desired such as a 55-gallon container, a 27-gallon container, a 17-gallon container, a 12-gallon container etc. Additionally, the lid 10 can be completely detachable from the container or coupled to the container, such as hingedly coupled to the container, for example.

In operation, and as detailed in FIG. 7, a second one of the lids 10 is stacked upon a first one of the lids 10, for example, for storage or transport. When stacked, upper portions of the bosses 52 and lip 18 of the first lid 10 are received within lower portions of the bosses 52 and lip of the second lid 10 to maintain alignment of the lids 10. In particular, the bosses 52 of the first lid 10 and the second lid 10 cooperate with one another and abut when the first lid 10 and the second lid 10 are stacked and fully nested in a stacked assembly.

As the depth of the first lid 10 within the second lid 10 progresses, the contact surfaces 60 of the support features of the second lid 10 also abut corresponding upper-exterior surfaces 62 of the bosses 52 of the first lid 10, militating against further advancement of the first lid 10 within the second lid 10.

Additionally, it should be understood that the first lid 10 and the second lid 10, being of similar design, results in an alignment of the respective first support features 55 and the second support features 57 about a same axis substantially orthogonal with the interior portions 16 of the first lid 10 and the second lid 10. This alignment upon stacking effectively results in a supporting rod or column of material disposed through the thickness of the stacked assembly, and advantageously contributes to a strength or robustness of the stack assembly while stacked.

In particular, by limiting the depth of the second lid 10 within the first lid 10, deformation of the lid 10, which is otherwise presented by exterior surfaces of the lip 18 and bosses 52 pressing outwardly on corresponding interior surfaces, is advantageously militated against during stacking of the lids 10 for storage or transport.

While certain representative embodiments and details have been shown for purposes of illustrating the invention, it will be apparent to those skilled in the art that various changes may be made without departing from the scope of the disclosure, which is further described in the following appended claims.

What is claimed is:

1. A stackable lid for a container, comprising:

a main body having an interior portion circumscribed by a lip, the main body further having a corner, an elongate side, and a handle area, the corner disposed between the elongate side and the handle area;

a plurality of bosses extending from the interior portion of the main body, each of the bosses including a plurality of sidewalls and having an interior surface, the plurality of bosses including a first boss, a second boss, and a third boss, the first boss disposed at the corner of the main body, the second boss disposed at the elongate side of the main body, and the third boss disposed at the handle area of the main body;

a pair of first support features, wherein one of the first support features depends from the interior surface of the first boss and an other of the first support features depends from the interior surface of the second boss, wherein the first support features are each tubular in shape; and a second support feature depending from the interior surface of the third boss, wherein the second support feature is cross shaped, wherein the first support features and the second support feature each further comprises at least one reinforcing rib and the reinforcing rib is connected to one of the sidewalls of one of the bosses.

2. The stackable lid of claim 1, wherein each of the first support features and the second support feature includes a planar contact surface.

3. The stackable lid of claim 2, wherein the contact surface is configured to abut an upper-exterior surface of a corresponding one of the bosses when a second one of the lids is stacked upon a first one of the lids.

4. The stackable lid of claim 1, wherein an entirety of each of the first support features and the second support feature is contained within a perimeter formed by the sidewalls of an associated one of the bosses within which each of the first support features and the second support feature is disposed.

5. The stackable lid of claim 1, wherein the second support feature that is cross-shaped includes a solid beam that extends outwardly from the interior surface of the third boss and a plurality of support fins or ribs attached to an outer surface of the support beam.

6. A stackable lid for a container, comprising:

a main body having an interior portion circumscribed by a lip, the main body further having a corner, an elongate side, and a handle area, the corner disposed between the elongate side and the handle area;

a plurality of bosses extending from the interior portion of the main body, each of the bosses including a plurality of sidewalls and having an interior surface, the plurality of bosses including a first boss, a second boss, and a third boss, the first boss disposed at the corner of the main body, the second boss disposed at the elongate side of the main body, and the third boss disposed at the handle area of the main body;

a pair of first support features wherein one of the first support features depends from the interior surface of the first boss and an other of the first support features depends from the interior surface of the second boss, wherein the first support feature is tubular in shape; and a second support feature depending from the interior surface of the third boss, wherein the second support feature is cross shaped;

wherein each of the first support features and the second support feature have a height that is less than a height of each of the plurality of sidewalls.

7. The stackable lid of claim 6, wherein each of the first support features and the second support feature includes a planar contact surface.

8. The stackable lid of claim 7, wherein the contact surface is configured to abut an upper-exterior surface of a corresponding one of the bosses when a second lid is stacked upon the stackable lid.

9. The stackable lid of claim 6, wherein the first support features each further comprises at least one reinforcing rib.

10. The stackable lid of claim 9, wherein the reinforcing rib is connected to one of the sidewalls of one of the bosses.

11. The stackable lid of claim 10, wherein an entirety of each of the first support features and the second support feature is contained within a perimeter formed by the sidewalls of the bosses within which each of the first support features and the second support feature are disposed.

12. An assembly of stackable lids, comprising:

a first stackable lid comprising a main body having an interior portion circumscribed by a lip, the main body further having a corner, an elongate side, and a handle area, the corner disposed between the elongate side and the handle area, a plurality of bosses extending from the interior portion of the main body, each of the bosses including a plurality of sidewalls, and having an interior surface, the plurality of bosses including a first boss, a second boss, and a third boss, the first boss disposed at the corner of the main body, the second boss disposed at the elongate side of the main body, and the third boss disposed at the handle area of the main body, a pair of first support features, wherein one of the first support features depends from the interior surface of the first boss and an other of the first support features depends from the interior surface of the second boss, wherein the first support features are each tubular in shape, and a second support feature depending from the interior surface of the third boss, wherein the second support feature is cross shaped; and a second stackable lid nested with and abutting the first stackable lid, the second stackable lid comprising a main body having an interior portion circumscribed by a lip, the main body further having a corner, an elongate side, and a handle area, the corner disposed between the elongate side and the handle area, a plurality of bosses extending from the interior portion of the main body, each of the bosses including a plurality of sidewalls, and having an interior surface, the plurality of bosses including a first boss, a second boss, and a third boss, the first boss disposed at the corner of the main body, the second boss disposed at the elongate side of the main body, and the third boss disposed at the handle area of the main body, a pair of first support features, wherein one of the first support features depends from the interior surface of the first boss and an other of the first support features depends from the interior surface of the second boss, wherein the first support features are each tubular in shape, and a second support feature depending from the interior surface of the third boss, wherein the second support feature is cross shaped, wherein each of first support features and the second support feature of the second stackable lid abuts an exterior surface of one of the bosses of the first stackable lid.

* * * * *